US009087630B2

(12) United States Patent
Camp, II et al.

(10) Patent No.: US 9,087,630 B2
(45) Date of Patent: Jul. 21, 2015

(54) CABLE BARRIER LAYER WITH SHIELDING SEGMENTS

(75) Inventors: David P. Camp, II, Florence, KY (US); Scott M. Brown, Independence, KY (US); Jared D. Weitzel, Cincinnati, OH (US)

(73) Assignee: General Cable Technologies Corporation, Highland Heights, KY (US)

( * ) Notice: Subject to any disclaimer, the term of this patent is extended or adjusted under 35 U.S.C. 154(b) by 463 days.

(21) Appl. No.: 13/246,207

(22) Filed: Sep. 27, 2011

(65) Prior Publication Data

US 2012/0080210 A1 Apr. 5, 2012

Related U.S. Application Data

(60) Provisional application No. 61/389,991, filed on Oct. 5, 2010, provisional application No. 61/393,620, filed on Oct. 15, 2010.

(51) Int. Cl.

| | |
|---|---|
| ***H01B 7/00*** | (2006.01) |
| ***H01B 11/06*** | (2006.01) |
| *H01B 11/10* | (2006.01) |

(52) U.S. Cl.

CPC ..... *H01B 11/06* (2013.01); *H01B 11/10* (2013.01)

(58) Field of Classification Search

CPC ..... H01B 11/00; H01B 11/02; H01B 11/06
USPC ..... 174/110 R, 113 R, 115, 116, 113 C
See application file for complete search history.

(56) References Cited

U.S. PATENT DOCUMENTS

| | | | | |
|---|---|---|---|---|
| 3,312,774 | A * | 4/1967 | Drinko et al. | 174/120 SC |
| 3,546,357 | A * | 12/1970 | Windeler et al. | 174/34 |
| 3,576,387 | A | 4/1971 | Derby | |
| 4,129,841 | A * | 12/1978 | Hildebrand et al. | 333/237 |
| 4,486,252 | A | 12/1984 | Lloyd | |
| 4,871,883 | A | 10/1989 | Guiol | |
| 5,106,538 | A | 4/1992 | Barma et al. | |
| 5,106,540 | A | 4/1992 | Barma et al. | |
| 5,171,938 | A | 12/1992 | Katsumata et al. | |

(Continued)

FOREIGN PATENT DOCUMENTS

| | | |
|---|---|---|
| CN | 101286384 | 10/2008 |
| EP | 0915486 | 5/1999 |

(Continued)

OTHER PUBLICATIONS

Donald M. Bigg, "Mechanical, Thermal, and Electrical Properties of Metal Fiber-Filled Polymer Composites", Polymer Engineering & Science, vol. 19, No. 16 (1979) pp. 1188-1192.

(Continued)

*Primary Examiner* — William H Mayo, III
(74) *Attorney, Agent, or Firm* — Ulmer & Berne LLP

(57) ABSTRACT

A cable that has a cable core that includes at least one conductor that is surrounded by insulation. A barrier layer substantially surrounds the conductor's insulation. The barrier layer may include a plurality of shielding segments. Each of the shielding segments extends substantially around a circumference of the barrier layer. The shielding segments may be spaced from one other to form a discontinuous shield around the conductor.

19 Claims, 1 Drawing Sheet

(56) References Cited

U.S. PATENT DOCUMENTS

| | | | | |
|---|---|---|---|---|
| 5,212,350 | A | 5/1993 | Gebs | |
| 5,473,336 | A * | 12/1995 | Harman et al. | 343/790 |
| 5,475,185 | A | 12/1995 | Tokarsky | |
| 5,477,011 | A | 12/1995 | Singles et al. | |
| 5,554,236 | A | 9/1996 | Singles et al. | |
| 5,929,138 | A | 7/1999 | Mercer et al. | |
| 5,946,798 | A | 9/1999 | Buluschek | |
| 5,956,445 | A | 9/1999 | Deitz, Sr. et al. | |
| 6,288,340 | B1 | 9/2001 | Arnould | |
| 6,384,326 | B1 * | 5/2002 | McFadden et al. | 174/36 |
| 6,484,392 | B1 | 11/2002 | Okada et al. | |
| 6,686,537 | B1 | 2/2004 | Gareis et al. | |
| 6,697,248 | B1 | 2/2004 | Luch | |
| 6,770,820 | B2 | 8/2004 | Sakurai et al. | |
| 7,120,005 | B1 | 10/2006 | Luch | |
| 7,332,676 | B2 | 2/2008 | Sparrowhawk | |
| 7,637,776 | B2 * | 12/2009 | McNutt et al. | 439/607.05 |
| 7,763,805 | B2 | 7/2010 | Stutzman | |
| 2002/0037376 | A1 * | 3/2002 | Fenton | 428/34.9 |
| 2003/0097064 | A1 | 5/2003 | Talpade et al. | |
| 2004/0026113 | A1 * | 2/2004 | Bahlmann et al. | 174/113 C |
| 2004/0055781 | A1 * | 3/2004 | Cornibert et al. | 174/135 |
| 2005/0006126 | A1 * | 1/2005 | Aisenbrey | 174/68.1 |
| 2005/0029000 | A1 * | 2/2005 | Aisenbrey | 174/35 MS |
| 2005/0045358 | A1 | 3/2005 | Arnold | |
| 2005/0077066 | A1 | 4/2005 | Stipes | |
| 2006/0048961 | A1 * | 3/2006 | Pfeiler et al. | 174/36 |
| 2006/0272856 | A1 | 12/2006 | Arnold | |
| 2006/0272857 | A1 | 12/2006 | Arnold | |
| 2007/0037419 | A1 * | 2/2007 | Sparrowhawk | 439/98 |
| 2007/0275583 | A1 * | 11/2007 | McNutt et al. | 439/225 |
| 2008/0072106 | A1 * | 3/2008 | Hamilton | 714/51 |
| 2008/0251276 | A1 | 10/2008 | Clark et al. | |
| 2008/0257599 | A1 | 10/2008 | Matsushita et al. | |
| 2008/0283290 | A1 | 11/2008 | Niino et al. | |
| 2009/0173511 | A1 * | 7/2009 | Smith et al. | 174/36 |
| 2010/0000780 | A1 | 1/2010 | Zhu et al. | |
| 2010/0096179 | A1 * | 4/2010 | Sparrowhawk et al. | 174/350 |

FOREIGN PATENT DOCUMENTS

| | | |
|---|---|---|
| GB | 2084385 | 9/1980 |
| GB | 2432963 | 4/2010 |
| WO | WO-2008/096348 | 8/2008 |

OTHER PUBLICATIONS

Li et al. "Conductive Coating Formulations with Low Silver Content", 2007 Electronics Components and Technology Conference, IEEE, p. 494-500.

* cited by examiner

CABLE BARRIER LAYER WITH SHIELDING SEGMENTS

RELATED APPLICATION

This application claims priority under 35 U.S.C. §119 to U.S. Provisional Application Ser. Nos. 61/389,991 and 61/393,620, filed on Oct. 5, 2010 and Oct. 15, 2010, respectively, and both entitled Cable Barrier With Shielding Segments, the subject matter of each of which is herein incorporated by reference.

FIELD OF THE INVENTION

The present invention relates to a shielding barrier layer for conductor pairs of an electrical cable that includes conductive shielding segments for shielding against electromagnetic interference and minimizing interaction effects with the cable's twisted wire pairs, wherein no grounding is required.

BACKGROUND OF THE INVENTION

A conventional communication cable typically includes a number of insulated conductors that are twisted together in pairs and surrounded by an outer jacket. Crosstalk or interference often occurs because of electromagnetic coupling between the twisted pairs within the cable or other components in the cable, thereby degrading the cable's performance. Also, as networks become more complex and have a need for higher bandwidth cabling, reduction of cable-to-cable crosstalk (alien crosstalk) becomes increasingly important.

To abate crosstalk between the cable's wire pairs, a large crossweb separator is usually added to the cable core to provide the required electrical isolation between the wire pairs to reduce interference. Conventional cables also often require tight twist lays on the conductor pairs to reduce pair-to-pair noise coupling. Such use of large insulated conductors, large separators, and tight pair lays, however, significantly increases the overall size of the cable.

Shielding layers are often used to reduce crosstalk. Conventional shielding layers for electrical cables typically include a continuous conductive material that is wrapped around the cable's core of twisted conductor pairs to isolate electromagnetic radiation from the core and also protect the core from outside interference. While a continuous conductive sheet is effective at containing any electromagnetic radiation inside the core, any cable using such a sheet must provide for grounding due to varying potentials in the line. Therefore, a need exists for a shielding wrap that can maintain its shielding properties while also eliminating the need for grounding.

SUMMARY OF THE INVENTION

Accordingly, the present invention provides a cable that comprises a cable core that includes at least one conductor that is surrounded by insulation. A barrier layer substantially surrounds the conductor's insulation. The barrier layer may include a plurality of shielding segments. Each of the shielding segments extends substantially around a circumference of the barrier layer. The shielding segments may be spaced from one other to form a discontinuous shield around the conductor.

The present invention also provides a cable that comprises a cable core that includes at least one conductor that is surrounded by insulation. A barrier layer substantially surrounds the conductor's insulation. The barrier layer has an outer surface that defines a circumference of the barrier layer. A plurality of shielding segments may be disposed on the outer surface of the barrier layer. Each of the shielding segments substantially extends around the circumference of the barrier layer. The shielding segments may be spaced from one other to form a discontinuous shield around the barrier layer.

The present invention also provides a cable that comprises a cable core that includes at least one conductor that is surrounded by insulation. A barrier layer substantially surrounds the conductor's insulation. The barrier layer may include a plurality of shielding segments embedded therein. Each of the shielding segments is formed of a plurality of conductive particles. Each of the shielding segments extends substantially around a circumference of the barrier layer. The shielding segments may be spaced from one other to form a discontinuous shield around the conductor.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
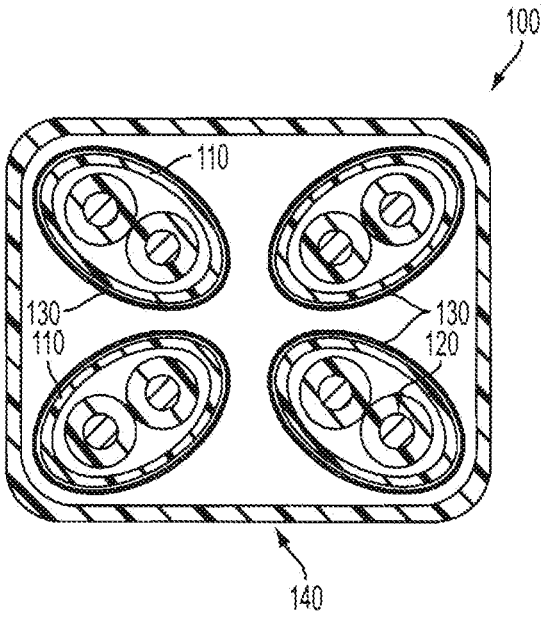
FIG. 1 is a cross-sectional view of a cable in accordance with an exemplary embodiment of the present invention.
Figure 2:
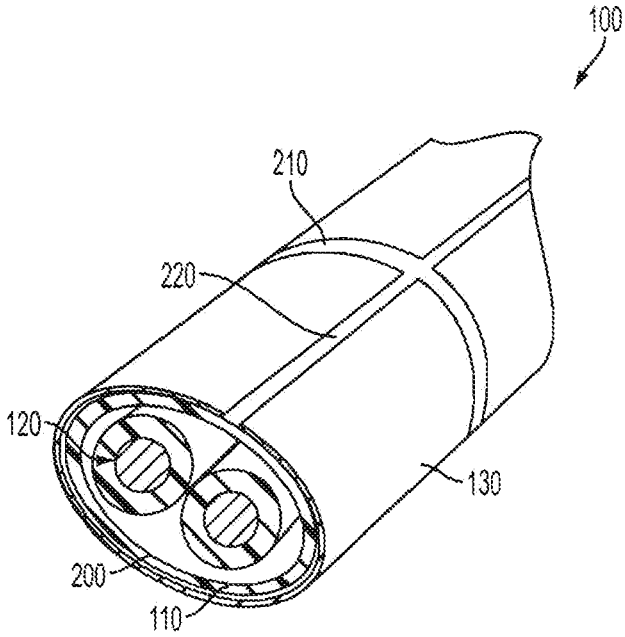
FIG. 2 is a perspective view of a pair of conductors of the cable illustrated in FIG. 1, showing the pair of conductors surrounded by an inner jacket with shielded segments in accordance with the present invention.

Referring to FIGS. 1 and 2, a cable, such as cable 100, according to exemplary embodiments of the present invention, generally includes one or more barrier layers, such as inner jackets 110, that surround the individual pairs of insulated conductors 120 of the cable core. Each barrier layer or inner jacket 110 may have a plurality of conductive shielding segments, such as segments 130, spaced from one another to form a discontinuous shield for each pair of conductors 120. An overall jacket 140 may surround the cable core, as seen in FIG. 1. Although the overall jacket 140 is shown as having a generally square cross-sectional shape, it may have any shape, such as circular.

By using the barrier layers or inner jackets, the overall size of the cable is reduced because the need for a bulky separator is eliminated. Also, the barrier layers allow longer pair lay lengths to be used which reduces the diameter of each pair while obtaining the same impedance. Moreover, the improved shielding and reduction of interference due to the shielding segments 130 of the barrier layers 110 allows the cable to accommodate higher speeds and applications, such as 40 Gb/s Ethernet. The barrier layers 110 with the shielding segments 130 also control capacitive and magnetic coupling between two adjacent cables resulting in improved alien crosstalk performance between the cables. The shielding is preferably discontinuous, thereby eliminating the need for grounding.

As best seen in FIG. 2, each barrier layer or inner jacket 110 may include a dielectric layer or substrate 200 with one or more of the conductive segments 130 disposed on an outer surface thereof, typically using a bonding agent, such as an adhesive, in accordance with an exemplary embodiment of the invention. The substrate 200 may be formed of a non-conductive material, for example, olefin, such as polypropylene or polyethylene, or a fluoropolymer, such as FEP, ECTFE, MFA, PFA and PTFE. In addition, the substrate 200 can be a non-conductive material which includes fibrous filler strands, in particular, woven or non-woven strands of fiberglass. Such fiberglass strands can be added to the substrate to improve the flame and smoke properties of the barrier layer. Fiberglass is typically neutral when compared to the flame and smoke properties of dielectric materials, such as fluoropolymers and olefins. The neutral fiberglass strands displace some of the dielectric material of the barrier layer. Also, substrate 200 could include more than one type of non-conductive material and/or multiple layers of different non-conductive materials. Use of different dielectric materials, such as olefins and fluoropolymers, also helps to balance the smoke and flame properties of the cable to achieve compliance with various fire safety requirements for commercial building installations, such as the NFPA 262 requirements for plenum rated cables and UL 1666 for riser rated cables.

The segments 130 are preferably made of aluminum but may be made of other electrically conductive materials, such as copper. The segments may have a thickness in the range of 0.0003 to 0.0030 inches, for example. The segments 130 may be arranged with gaps 210 in between, as seen in FIG. 2, which provide electrical interruption in the longitudinal direction of the cable. As seen in FIG. 2, the segments are spaced both circumferentially and longitudinally with respect to the longitudinal axis of the cable, thereby forming a discontinuous shield in both the circumferential and longitudinal directions. That electrical interruption prevents longitudinal conductivity along the cable, thereby eliminating the need for grounding. The shielding segments 130 reduce capacitive coupling between adjacent pairs 110 resulting in improved EMC (electromagnetic compatibility) performance and provide a consistent high frequency impedance. The magnitude of longitudinal impedance of the barrier layers 110 with the segments 130, as a result of the capacitive coupling, can be adjusted depending on the lengths and widths of the individual segments 130, the size of the gaps 210 between the segments 130, and the proximity of the segments 130 to the core of twisted wire pairs 110. Lower longitudinal impedance is preferred to reduce the amount of energy absorbed by the barrier layers and therefore reduce the losses of signal on the twisted pair. However, the lower impedance should be balanced against the need for shielding. The length of the segments 130 or the width of the gaps 210 between the segments 130 around any given pair may be more than twice the twist lay of that pair to reduce inherent resonances. However, random segment lengths or gap spacing is preferred. Thicker segments may improve shielding and signal attenuation along the pair.

Each segment 130 preferably has a rectangular shape. Also, each segment 130 preferably extends substantially around the entire circumference of the barrier layer or inner jacket 110, such that a small space 220 remains between the ends of the segment, as best seen in FIG. 2, to provide sufficient shielding. The gaps 210 between the segments 130 are sized to ensure at least 90% coverage of the circumferential surface area around the pair 120 by the segments 130 to improve shielding.

The shapes, lengths and widths of the individual segments 130 may be designed or modified to maximize the barrier layer or jacket's 110 shielding properties and electrical performance of the cable, and minimize interaction effects with the core of twisted wire pairs, e.g. alien crosstalk with adjacent cables, while eliminating the need for grounding. For example, various shapes of the segments 130 may be used, such as square, rectangular, parallelogram, trapezoidal, chevron, diamond, and the like. Also, random sized segments 130 may be used to reduce resonance between the segments 130. The segments 130 may be random in length and width to minimize interaction with the twisted wire pairs 120, as well as to reduce interference with neighboring cables, i.e. alien crosstalk. Alternatively, the lengths and widths of the segments 130 can all be the same or fixed and the twist lay length of the conductor pairs 120 varied to minimize interference.

Several advantages of using the shielding segments 130 are provided in addition to eliminating the need for grounding. For example, the barrier layers 110 incorporating the shielding segments 130 provide (a) less signal attenuation at high frequencies along the pairs 120, which helps flatten the insertion loss curve compared to an unshielded twisted pair cable (UTP); (b) improved shielding between the pairs 120, thereby improving crosstalk between the pairs within the cable referred to as near end crosstalk (NEXT) and pairs within adjacent cables stacked in a given pathway, referred to as alien crosstalk (ANEXT), as typically seen in commercial building installation; and (c) improvements in high frequency attenuation and crosstalk in the cable which improves the overall high frequency attenuation-to-crosstalk ratio (ACR) for a given core design—an improved ACR increases the received signal-to-noise ratio in a transmission system and therefore increases the band width by allowing positive ACR at higher frequencies.

In accordance with an alternative embodiment of the present invention, the shielding segments 130 may be a coating on the barrier layers or jackets 110. That is, a conductive coating may be applied to the outer surface of the barrier layers or jackets 110 in the form of segments similar to the segments 130. In accordance with yet another embodiment of the present invention, the shielding segments 130 may be embedded in or disposed on an outer surface of the barrier layers or jackets 110, as disclosed in commonly owned application Ser. No. 13/246,183 entitled Shielding For Communication Cables Using Conductive Particles, filed concurrently herewith, the subject matter of which is herein incorporated by reference. In other words, conductive particles, selected from, for example, aluminum, iron oxides, nickel, zinc, silver or carbon nano-fibers, for example, may be embedded in the substrate 200, so as to form the segments 130 in the barrier layers or jackets 110.

Although the barrier layers of the exemplary embodiments of the present invention are preferably extruded over the conductor pairs, the barrier layers 110 may be formed as a split tube, as disclosed in commonly owned, co-pending Application Ser. No. 13/227,125, entitled Cable With a Split Tube and Method For Making The Same, the subject matter of which is hereby incorporated by reference.

While particular embodiments have been chosen to illustrate the invention, it will be understood by those skilled in the art that various changes and modifications can be made therein without departing from the scope of the invention as defined in the appended claims. For example, although the cables of the exemplary embodiment are shown as having four conductor pairs, any number of pairs may be used. Moreover, the present invention contemplates that any combination of pairs may be used with or without barrier layers.

What is claimed is:

1. A cable, comprising:

a cable core, comprising:

a plurality of insulated conductors forming at least one twisted insulated conductor pair;

one or more barrier layers, each of the one or more barrier layers comprising a substrate layer and a shielding layer, wherein one of the barrier layers surrounds one of the twisted insulated conductor pairs, such that the substrate layer substantially continuously surrounds said twisted insulated conductor pair, the shielding layer comprises a plurality of shielding segments longitudinally spaced apart and extending substantially around an outer surface of the substrate layer, and wherein the shielding layer has gaps in both the circumferential and longitudinal directions; and wherein the total length of the shielding segments or the circumferential gaps for one or more of the at least one twisted insulated conductor pair are at least twice the twist lay of said twisted insulated conductor pair.

2. The cable according to of claim 1, further comprising an outer jacket that surrounds the cable core.

3. The cable of claim 1 comprises a plurality of barrier layers, and wherein each of the plurality of barrier layers surrounds one of the at least one twisted insulated conductor pair.

4. The cable of claim 3, further comprising an outer jacket that surrounds the cable core.

5. The cable of claim 1, wherein the substrate layer comprises polyester, polyolefin, fluoropolymer, and woven or non-woven fibrous filler strands of fiberglass.

6. The cable of claim 5, wherein the substrate layer comprises two or more layers of polyolefin, fluoropolymer, and combinations thereof.

7. The cable of claim 1, wherein each of the plurality of shielding segments has a random longitudinal length.

8. The cable of claim 1, wherein each of the plurality of shielding segments have a uniform longitudinal length; and each twisted insulated conductor pair has a twist lay of different lengths.

9. A cable, comprising:

a cable core, comprising, a plurality of insulated conductors forming at least one twisted insulated conductor pair;

one or more barrier layers, each of the one or more barrier layers comprising a substrate layer and a shielding layer, wherein one of the barrier layers surrounds one of the twisted insulated conductor pairs, such that the substrate layer substantially continuously surrounds said twisted insulated conductor pair, and the shielding layer comprises a plurality of shielding segments longitudinally spaced apart and disposed on an outer surface of the substrate layer, each of the plurality of shielding segments extending substantially around the outer surface of the substrate layer, and wherein the shielding layer has gaps in both the circumferential and longitudinal directions; and wherein the total length of the shielding segments or the circumferential gaps for one or more of the at least one twisted insulated conductor pair are at least twice the twist lay of said twisted insulated conductor pair.

10. The cable of claim 9, wherein each of the plurality of shielding segments has a substantially rectangular shape.

11. The cable of claim 9, wherein each of the plurality of shielding segments comprises foil.

12. The cable of claim 9 comprises a plurality of barrier layers, and wherein each of the plurality of barrier layers surrounds one of the at least one twisted insulated conductor pairs.

13. The cable of claim 12, further comprising an outer jacket that surrounds the cable core.

14. The cable of claim 9, wherein the substrate layer comprises polyester, polyolefin, fluoropolymer, and woven or non-woven fibrous filler strands of fiberglass.

15. The cable of claim 9, wherein each of the shielding segments comprises aluminum or copper.

16. A cable, comprising:

a cable core comprising:

a plurality of insulated conductors forming at least one twisted insulated conductor pair;

one or more barrier layers, each of the one or more barrier layers comprising a substrate layer and a shielding layer, wherein one of the barrier layers surrounds one of the twisted insulated conductor pairs, such that the substrate layer substantially continuously surrounds said twisted insulated conductor pair, the shielding layer comprises a plurality of shielding segments longitudinally spaced apart and embedded in the substrate layer, each of the plurality of shielding segments extending substantially around a circumference of the substrate layer, each of the plurality of shielding segments comprising a plurality of conductive particles, and wherein the shielding layer has gaps in both the circumferential and longitudinal directions; and wherein the total length of the shielding segments or the circumferential gaps for one or more of the at least one twisted insulated conductor pair are at least twice the twist lay of said twisted insulated conductor pair.

17. The cable of claim 16, wherein the plurality of conductive particles are selected from the group consisting of iron oxides, nickel, zinc, silver, carbon nano-fibers, or combinations thereof.

18. The cable of claim 16, wherein the substrate layer comprises polyester, polyolefin, fluoropolymer, and woven or non-woven fibrous filler strands of fiberglass.

19. The cable of claim 16 comprises a plurality of barrier layers, and wherein each of the plurality of barrier layers surrounds at least one of the twisted insulated conductor pairs.

* * * * *

UNITED STATES PATENT AND TRADEMARK OFFICE

CERTIFICATE OF CORRECTION

PATENT NO. : 9,087,630 B2
APPLICATION NO. : 13/246207
DATED : July 21, 2015
INVENTOR(S) : David P. Camp, II et al.

It is certified that error appears in the above-identified patent and that said Letters Patent is hereby corrected as shown below:

In the claims

Claim 2, column 5, line 18, change "according to of claim 1" to --of claim 1--.

Signed and Sealed this
Fifteenth Day of December, 2015

Michelle K. Lee

Michelle K. Lee
*Director of the United States Patent and Trademark Office*